US006617797B2

(12) United States Patent
Higuchi et al.

(10) Patent No.: US 6,617,797 B2
(45) Date of Patent: Sep. 9, 2003

(54) DISPLAY APPARATUS AND DISPLAY METHOD

(75) Inventors: Yasunori Higuchi, Nakakoma-gun (JP); Hitoshi Mochizuki, Nakakoma-gun (JP)

(73) Assignees: Pioneer Corporation, Tokyo (JP); Pioneer Display Products Corporation, Fukuroi (JP)

( * ) Notice: Subject to any disclaimer, the term of this patent is extended or adjusted under 35 U.S.C. 154(b) by 0 days.

(21) Appl. No.: 10/150,970

(22) Filed: May 21, 2002

(65) Prior Publication Data

US 2002/0195957 A1 Dec. 26, 2002

(30) Foreign Application Priority Data

Jun. 8, 2001 (JP) ..... 2001-174062

(51) Int. Cl.[7] ..... G09G 3/10

(52) U.S. Cl. ..... 315/169.1; 315/169.3; 345/98; 345/213; 345/690

(58) Field of Search ..... 315/169.1, 169.2, 315/169.4, 169.3; 345/60, 63, 68, 84, 98, 101, 211–214, 690

(56) References Cited

U.S. PATENT DOCUMENTS 5,724,053 A * 3/1998 Nagakubo ..... 345/60
6,340,961 B1 * 1/2002 Tanaka et al. ..... 345/63
6,396,508 B1 * 5/2002 Noecker ..... 345/693
6,476,824 B1 * 11/2002 Suzuki et al. ..... 345/690
6,496,165 B1 * 12/2002 Ide et al. ..... 345/60

* cited by examiner

*Primary Examiner*—Haissa Philogene
(74) *Attorney, Agent, or Firm*—McGinn & Gibb, PLLC

(57) ABSTRACT

A display apparatus, in which an image shown by an input image signal is divided into a plurality of blocks, an average luminance level of the image signal in each block is detected, adjacent blocks having a relation such that a difference of the average luminance levels is equal to or larger than a predetermined level are detected from the plurality of blocks on the basis of the average luminance level of each of the plurality of blocks, a luminance restriction command signal is generated when it is detected that the adjacent blocks have continued the state where the difference of the average luminance levels is equal to or larger than the predetermined level for a predetermined time, and the image corresponding to the image signal is displayed while restricting the luminance level of the image signal in response to the luminance restriction command signal.

3 Claims, 3 Drawing Sheets

| | 1 | 2 | 3 | 4 | 5 | 6 |
|---|---|---|---|---|---|---|
| 1 | | | LOW | HIGH | HIGH | LOW |
| 2 | | | LOW | HIGH | HIGH | LOW |
| 3 | | | LOW | LOW | LOW | LOW |
| 4 | | | | | | |
| 5 | | | | | | |

FIG.3A

| | 1 | 2 | 3 | 4 | 5 | 6 |
|---|---|---|---|---|---|---|
| 1 | | | LOW | HIGH | | |
| 2 | | | LOW | HIGH | | |
| 3 | | | LOW | LOW | | |
| 4 | | | | | | |
| 5 | | | | | | |

FIG.3B

| | 1 | 2 | 3 | 4 | 5 | 6 |
|---|---|---|---|---|---|---|
| 1 | | | LOW | HIGH | | |
| 2 | | | LOW | HIGH | | |
| 3 | | | | | | |
| 4 | | | | | | |
| 5 | | | | | | |

FIG.3C

HIGH : HIGH LUMINANCE BLOCK
LOW : LOW LUMINANCE BLOCK

DISPLAY APPARATUS AND DISPLAY METHOD

BACKGROUND OF THE INVENTION

1. Field of the Invention

The present invention relates to a display apparatus having a display panel such as a plasma display panel of a matrix display system and to a displaying method regarding the display panel.

2. Description of the Related Arts

In a display apparatus using a display panel such as a plasma display panel, an average luminance level of an image signal is obtained and, when the average luminance level increases to a reference value or more, luminance is restricted. This is because it is intended to suppress electric power consumption of the display apparatus and prevent deterioration of the display panel which results from heat generation.

There is, however, a problem such that if the luminance restriction is performed by giving a priority to the prevention of the heat generation from the display panel, the luminance is restricted more than necessary, so that an image on the display panel becomes dark.

SUMMARY OF THE INVENTION

It is, therefore, an object of the present invention to provide display apparatus and method which can prevent heat generation from a display panel without unnecessarily reducing a luminance level.

According to the invention, there is provided a display apparatus comprising: an average luminance level detector for dividing a frame shown by an input image signal into a plurality of blocks and detecting an average luminance level of the image signal in each of the plurality of blocks; an adjacent block detector for detecting adjacent blocks having a relation such that a difference of the average luminance levels is equal to or larger than a predetermined level from the plurality of blocks in accordance with the average luminance level of each of the plurality of blocks detected by the average luminance level detector; a state continuation detector for detecting that the adjacent blocks detected by the adjacent block detector have continued the state where the difference of the average luminance levels is equal to or larger than the predetermined level for a predetermined time, to generate a luminance restriction command signal; and a display element for displaying an image corresponding to the image signal while restricting a luminance level of the image signal in response to the luminance restriction command signal.

According to the invention, there is provided a displaying method comprising the steps of: dividing a frame shown by an input image signal into a plurality of blocks and detecting an average luminance level of the image signal in each of the plurality of block; detecting adjacent blocks having a relation such that a difference of the average luminance levels is equal to or larger than a predetermined level from the plurality of blocks in accordance with the average luminance level of each of the plurality of blocks; detecting that the adjacent blocks have continued the state where the difference of the average luminance levels is equal to or larger than the predetermined level for a predetermined time, to generate a luminance restriction command signal; and displaying an image corresponding to the image signal while restricting a luminance level of the image signal in response to the luminance restriction command signal.

BRIEF DESCRIPTION OF THE DRAWINGS

FIGS. 3A to 3C are diagrams showing high luminance blocks and low luminance blocks in an image.

DETAILED DESCRIPTION OF THE PREFERRED EMBODIMENT

An embodiment of the invention will be described in detail hereinbelow with reference to the drawings.

Figure 1:
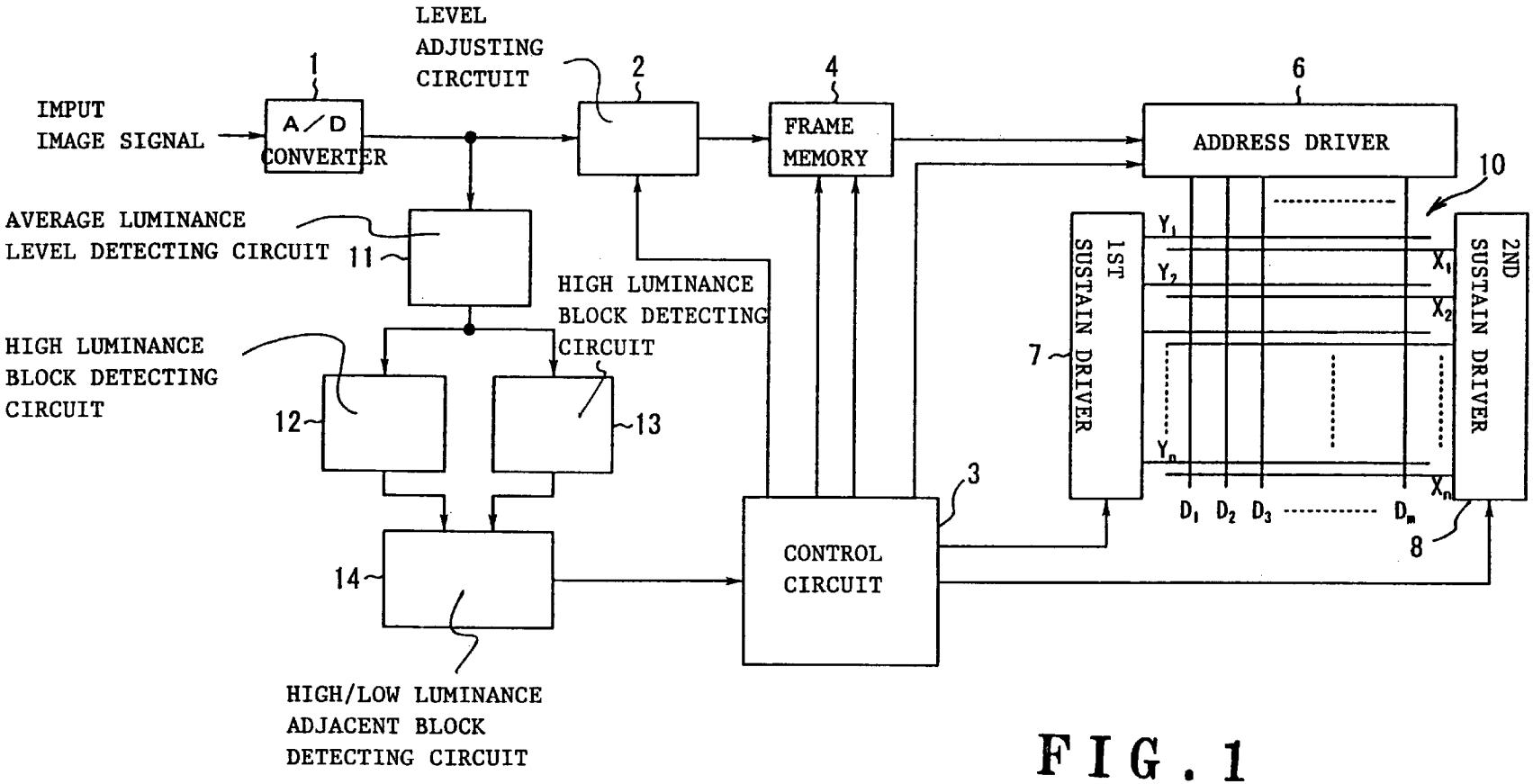
FIG. 1 is a block diagram showing an embodiment of the invention.

FIG. 1 is a diagram showing a schematic construction of a display apparatus using a plasma display panel (hereinafter, referred to as a PDP) according to the invention.

As shown in FIG. 1, the display apparatus comprises: an A/D converter 1; a level adjusting circuit 2; a control circuit 3; a frame memory device 4; an address driver 6; first and second sustain drivers 7 and 8; a PDP 10; an average luminance level detecting circuit 11; a high luminance block detecting circuit 12; a low luminance block detecting circuit 13; and a high/low luminance adjacent block detecting circuit 14.

The A/D converter 1 samples an analog input image signal in response to a clock signal which is supplied from the control circuit 3, converts the sampled signal into pixel data (input pixel data) D of, for example, 8 bits every pixel, and supplies it to the level adjusting circuit 2 and average luminance level detecting circuit 11.

The level adjusting circuit 2 adjusts a luminance level of the supplied pixel data D in response to a level restriction command which is supplied from the control circuit 3.

Synchronously with horizontal and vertical sync signals in the input image signal, the control circuit 3 generates a clock signal to the A/D converter 1 and write/read signals to the frame memory device 4. Further, synchronously with the horizontal and vertical sync signals, the control circuit 3 generates various timing signals for driving each of the address driver 6, first sustain driver 7, and second sustain driver 8. When an adjacent block continuation detection signal, which will be explained hereinlater, is supplied from the high/low luminance adjacent block detecting circuit 14, the control circuit 3 generates the level restriction command to the level adjusting circuit 2.

The frame memory device 4 sequentially writes the pixel data D supplied from the level adjusting circuit 2 into an internal memory body (not shown) in accordance with the write signal supplied from the control circuit 3. When the writing of the data of one frame (n rows, m columns) is finished by the writing operation, the frame memory device 4 divides the pixel data of one frame every bit digit, reads out the divided data from the internal memory body, and sequentially supplies them every row to the address driver 6.

The address driver 6 generates m pixel data pulses each having a voltage corresponding to the logic level of each of the pixel data bits of one row read out from the frame memory device 4 in response to the timing signal supplied from the control circuit 3, and applies them to column electrodes $D_1$ to $D_m$ of the PDP 10, respectively.

The PDP 10 has the column electrodes $D_1$ to $D_m$ as address electrodes and row electrodes $X_1$ to $X_n$ and row electrodes $Y_1$ to $Y_n$ arranged so as to perpendicularly cross the column electrodes. In the PDP 10, row electrodes corresponding to one row are formed by a pair of row electrodes X and Y. That is, the row electrode pair of the first row in the PDP 10 is the row electrodes $X_1$ and $Y_1$ and the row electrode pair of the nth row is the row electrodes $X_n$ and $Y_n$, respectively. Each of the row electrode pairs and the column electrodes is coated with a dielectric layer for a discharge space. A discharge cell corresponding to one pixel is formed at a cross point of each of the row electrode pairs and each of the column electrodes.

Each of the first sustain driver 7 and the second sustain driver 8 generates various driving pulses as will be explained hereinlater in response to the timing signals supplied from the control circuit 3, and applies them to the row electrodes $X_1$ to $X_n$ and $Y_1$ to $Y_n$ of the PDP 10.

The average luminance level detecting circuit 11 divides one frame corresponding to the screen of the PDP 10 into a predetermined number of blocks (for example, 6 blocks in the lateral direction×5 blocks in the vertical direction), detects an average luminance level of each block on the basis of the pixel data D which is supplied from the A/D converter 1, and generates average luminance data of each block to the high luminance block detecting circuit 12 and low luminance block detecting circuit 13.

The high luminance block detecting circuit 12 detects a block of which an average luminance level is equal to or larger than a first reference value Th1, that is, a high luminance block from the average luminance data of each block which is supplied from the average luminance level detecting circuit 11. The low luminance block detecting circuit 13 detects a block of which an average luminance level is equal to or smaller than a second reference value Th2 (Th2<Th1), that is, a low luminance block from the average luminance data of each block which is supplied from the average luminance level detecting circuit 11. High luminance block data indicative of the position of the high luminance block detected by the high luminance block detecting circuit 12 and low luminance block data indicative of the position of the low luminance block detected by the low luminance block detecting circuit 13 are supplied to the high/low luminance adjacent block detecting circuit 14.

The high/low luminance adjacent block detecting circuit 14 detects the blocks in which the high luminance block and the low luminance block are adjacent to each other in the present frame in accordance with the high luminance block data and the low luminance block data, and further generates an adjacent block continuation detection signal to the control circuit 3 in the case where the adjacent blocks continue in the same state for a predetermined time.

In the display apparatus to which the invention with the above construction is applied, when the average luminance data of an arbitrary block which is sequentially supplied from the average luminance level detecting circuit 11 is equal to or larger than the first reference value Th1, the block is detected by the high luminance block detecting circuit 12. When the average luminance data of an arbitrary block which is sequentially supplied from the average luminance level detecting circuit 11 is equal to or smaller than the second reference value Th2, the block is detected by the low luminance block detecting circuit 13.

Figure 2:
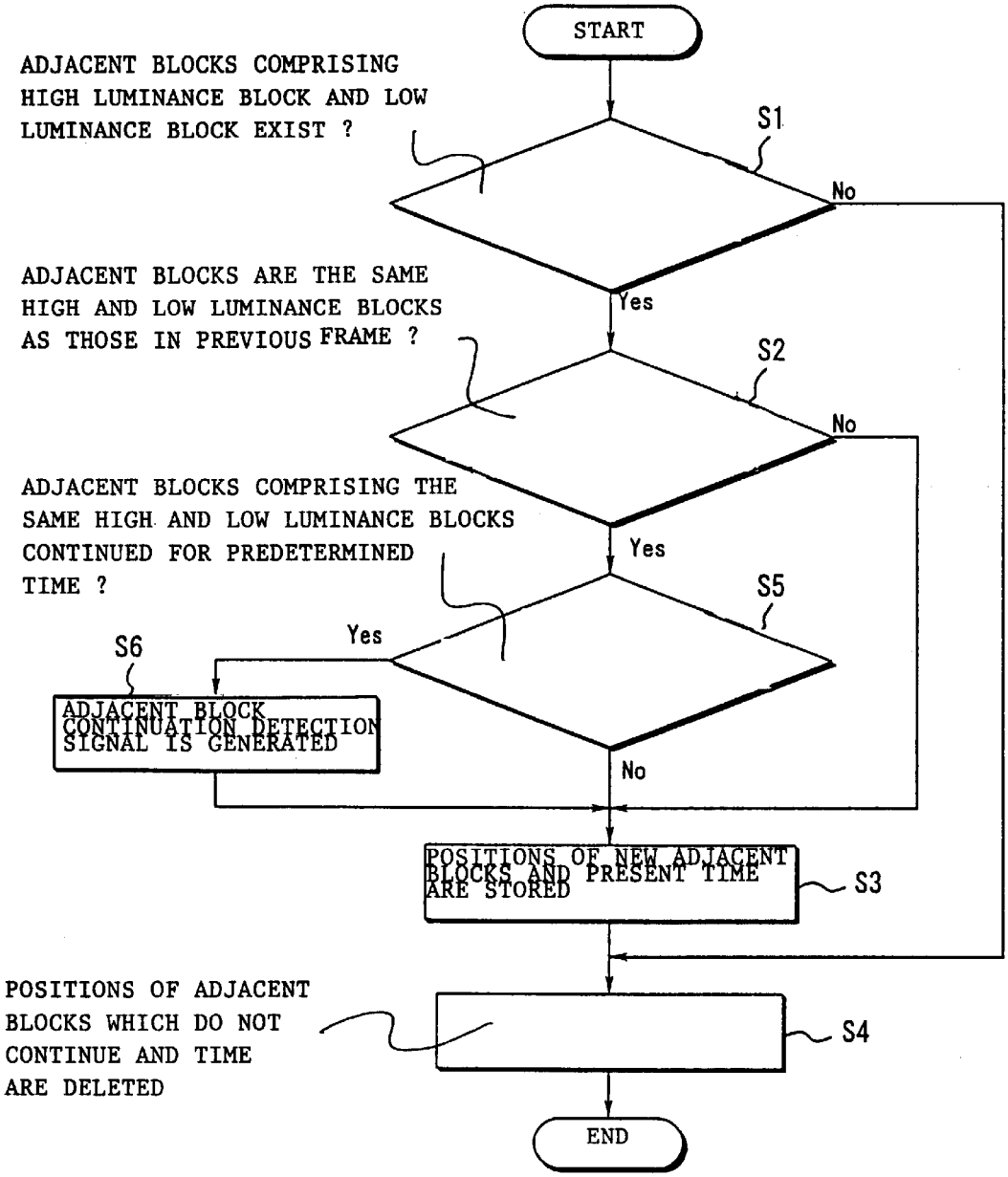
FIG. 2 is a flowchart showing the operation of a high/low luminance adjacent block detecting circuit.

The high/low luminance adjacent block detecting circuit 14 discriminates for each frame whether the adjacent blocks (block pair), which consist of a high luminance block and a low luminance block, exist or not in the detected high luminance block (blocks) and low luminance block (blocks) (step S1), as shown in FIG. 2. If the adjacent blocks in which the high luminance block and the low luminance block are neighboring mutually exist, whether the adjacent blocks have already been detected as adjacent blocks consisting of the same high luminance block and low luminance block in the previous frame or not is discriminated (step S2). If the present detected adjacent blocks are not the adjacent blocks consisting of the same high luminance block and low luminance block in the previous frame, the positions of the adjacent blocks and the present time are stored into an internal memory (not shown) (step S3). After completion of the execution in step S3, the positions of the adjacent blocks which do not continue in the previous and present frames and the stored time are deleted from the internal memory (step S4). Step S4 is also executed in the case where the adjacent blocks consisting of a high luminance block and a low luminance block do not exist in the present frame.

If it is determined in step S2 that the adjacent blocks in the present frame has already continued the state of the same high luminance block and low luminance block in the previous frame, whether the state of the same high luminance block and low luminance block has continued for a predetermined time or not is discriminated (step S5). The continuation time is discriminated from the time stored in the internal memory. The predetermined time is set to, for example, a few seconds. If the adjacent blocks have continued the state of the same high luminance block and low luminance block for the predetermined time, the adjacent block continuation detection signal is generated to the control circuit 3 (step S6).

If the adjacent blocks do not continue the state of the same high luminance block and low luminance block for the predetermined time, step S3 follows. Also after completion of the execution in step S6, the processing routine advances to step S3.

It is now assumed that in the case where one frame is divided into, for example, blocks (6 blocks in the lateral direction×5 blocks in the vertical direction), high luminance blocks and low luminance blocks are detected at block positions as shown in FIG. 3A for the first time. In the next frame, if high luminance blocks and low luminance blocks are detected at block positions as shown in FIG. 3B, as adjacent blocks in which the high luminance block and the low luminance block are neighboring mutually, there are three pairs of adjacent blocks represented by (lateral, vertical) coordinates (3, 1)(4, 1), (3, 2)(4, 2), and (4, 2)(4, 3). Among the three pairs of adjacent blocks, if the adjacent blocks (3, 1)(4, 1) and (3, 2)(4, 2) have continued the same high luminance blocks and low luminance blocks for the predetermined time as shown in FIG. 3C, temperature differences in respective boundary portions of the high luminance blocks and the low luminance blocks are remarkably large. When the adjacent blocks in which the high luminance block and the low luminance block are neighboring mutually have continued the same high luminance block and low luminance block for the predetermined time as mentioned above, therefore, the adjacent block continuation detection signal is generated from the high/low luminance adjacent block detecting circuit 14.

The control circuit 3 issues a level restriction command to the level adjusting circuit 2 in response to the adjacent block continuation detection signal. In response to the level restriction command, the level adjusting circuit 2 restricts the luminance level of the supplied pixel data D. The restricted pixel data D is supplied to the frame memory device 4. After completion of the writing operation and the reading operation of the pixel data D into/from the frame memory device 4, the pixel data D is sequentially supplied to the address driver 6. The PDP 10 is driven by the address driver 6, first sustain driver 7, and second sustain driver 8, so that an image corresponding to the input image signal is displayed by the PDP 10. In the display by the PDP 10, if the luminance level of the pixel data D is restricted by the level adjusting circuit 2, the large temperature difference is suppressed in the boundary portion of the high luminance block and the low luminance block, so that the deterioration of the display panel of the PDP 10 can be prevented.

According to the driving using the subfield method in order to realize the halftone luminance display corresponding to the input image signal by the PDP 10, the display period of time of one field is divided into N subfields, the number of light emitting times corresponding to the weight of the bit digit of the pixel data (N bits) according to the input image signal is allocated every subfield, and the light emission driving is performed. In place of the luminance level adjustment by the level adjusting circuit 2, therefore, the number of light emitting times of each subfield can be also reduced in response to the adjacent block continuation detection signal.

Although the embodiment has been described with respect to the example in which the invention is applied to the display apparatus using the PDP, the invention is not limited to it but can be also applied to another display apparatus using a display panel with an organic EL device.

As mentioned above, according to the invention, since the heat generation of the display panel of the display apparatus is properly prevented, the luminance level does not decrease unnecessarily and a situation that the frame is darkened due to the luminance restriction as in the conventional apparatus can be prevented.

This application is based on a Japanese Patent Application No. 2001-174062 which is hereby incorporated by reference.

What is claimed is:

1. A display apparatus comprising:

an average luminance level detector for dividing a frame shown by an input image signal into a plurality of blocks and detecting an average luminance level of said image signal in each of the plurality of blocks;

an adjacent block detector for detecting adjacent blocks having a relation such that a difference of the average luminance levels is equal to or larger than a predetermined level from the plurality of blocks in accordance with the average luminance level of each of the plurality of blocks detected by said average luminance level detector;

a state continuation detector for detecting that the adjacent blocks detected by said adjacent block detector have continued the state where the difference of the average luminance levels is equal to or larger than the predetermined level for a predetermined time, to generate a luminance restriction command signal; and a display element for displaying an image corresponding to said image signal while restricting a luminance level of said image signal in response to said luminance restriction command signal.

2. An apparatus according to claim 1, wherein said adjacent block detector includes:

a high luminance block detector for comparing the average luminance level of each of said plurality of blocks detected by said average luminance level detector with a first reference value, thereby detecting a block whose average luminance level is equal to or larger than said first reference value;

a low luminance block detector for comparing the average luminance level of each of said plurality of blocks detected by said average luminance level detector with a second reference value, thereby detecting a block whose average luminance level is equal to or smaller than said second reference value; and a block pair detector for detecting a block pair in which the block detected by said high luminance block detector and the block detected by said low luminance block detector are neighboring mutually as the adjacent blocks.

3. A displaying method comprising the steps of:

dividing a frame shown by an input image signal into a plurality of blocks and detecting an average luminance level of said image signal in each of the plurality of blocks;

detecting adjacent blocks having a relation such that a difference of the average luminance levels is equal to or larger than a predetermined level from the plurality of blocks in accordance with the average luminance level of each of the plurality of blocks;

detecting that the adjacent blocks have continued the state where the difference of the average luminance levels is equal to or larger than the predetermined level for a predetermined time, to generate a luminance restriction command signal; and displaying an image corresponding to said image signal while restricting a luminance level of said image signal in response to said luminance restriction command signal.

* * * * *